US006669058B1

(12) United States Patent
Sweeton

(10) Patent No.: US 6,669,058 B1
(45) Date of Patent: Dec. 30, 2003

(54) TRIGGER SPRAYER WITH NOZZLE TRIGGER LOCK

(75) Inventor: Steven L. Sweeton, Lee's Summit, MO (US)

(73) Assignee: Saint-Gobain Calmar Inc., City of Industry, CA (US)

( * ) Notice: Subject to any disclaimer, the term of this patent is extended or adjusted under 35 U.S.C. 154(b) by 0 days.

(21) Appl. No.: 10/282,037

(22) Filed: Oct. 29, 2002

(51) Int. Cl.[7] ..... B67B 5/00
(52) U.S. Cl. ..... 222/153.13; 222/153.14
(58) Field of Search ..... 222/153.13, 153.14, 222/380; 215/220

(56) References Cited

U.S. PATENT DOCUMENTS

| | | | | |
|---|---|---|---|---|
| 3,907,174 A | * | 9/1975 | Steiman | 222/153.13 |
| 5,482,186 A | | 1/1996 | Rodden, Jr. | 222/153.07 |
| 5,647,539 A | | 7/1997 | Dobbs et al. | 239/504 |
| 5,687,880 A | * | 11/1997 | Maas et al. | 222/153.14 |
| 6,006,950 A | | 12/1999 | Watanabe et al. | 222/153 |
| 6,105,826 A | * | 8/2000 | Oursin et al. | 222/153.06 |
| 6,186,366 B1 | * | 2/2001 | Good et al. | 222/153.14 |
| 6,478,193 B1 | * | 11/2002 | Good et al. | 222/153.14 |

FOREIGN PATENT DOCUMENTS

| | | |
|---|---|---|
| JP | 10-146542 | 6/1998 |
| JP | 2000-70792 | 3/2000 |
| JP | 2000-70793 | 3/2000 |
| JP | 2000-70794 | 3/2000 |
| JP | 2000-237646 | 9/2000 |
| JP | 2001-9331 | 1/2001 |
| JP | 2001-10653 | 1/2001 |
| JP | 2001-39461 | 2/2001 |

* cited by examiner

*Primary Examiner*—Gene Mancene
*Assistant Examiner*—Melvin Cartagena
(74) *Attorney, Agent, or Firm*—Dykema Gossett PLLC

(57) ABSTRACT

A trigger actuated pump sprayer has a lock bar connected to its nozzle cap or foamer cap for rotation therewith for both locking the trigger lever against actuation and for locking the nozzle cap against rotation from a discharge closed position, the lock bar having a bendable tab for coupling the lock bar to the trigger lever to prevent nozzle rotation in either direction of rotation.

8 Claims, 2 Drawing Sheets

TRIGGER SPRAYER WITH NOZZLE TRIGGER LOCK

BACKGROUND OF THE INVENTION

This invention relates generally to a trigger actuated pump sprayer, and more particularly to such a sprayer having a nozzle/trigger lock rendering the sprayer child-resistant.

The trigger actuated sprayer of known variety typically has a spray nozzle rotatable about its central axis between discharge open and closed positions.

There may be two open and two intervening closed positions such that from a given closed position, the nozzle is capable of being rotated 90° in either direction to an open position.

When in the discharge closed position, the trigger lever is nevertheless capable of being actuated although the sprayer is designed such that product is not intended to discharge from the nozzle even under these circumstances. Nevertheless, it is has been found that some residual quantity of liquid remains within the nozzle such that even in a discharge closed position actuation of the trigger lever could produce a minor amount of unwanted discharge.

Moreover, the nozzle may need to be locked in its discharge closed position with the trigger lever is locked against actuation as a safety feature for liquids which may be toxic or poisonous.

The prior art teaches the provision of a bar connected to the nozzle cap and overlying the trigger lever to prevent trigger actuation until the bar and nozzle are rotated to an open position. However, the nozzle and lock bar are rotatable in only one direction as permitted by a tab on the bar which engages one side of the lever. Besides, the bar is not coupled to the trigger lever such that the nozzle cap is not locked against rotation.

It would be of benefit to lock both the nozzle in one of its discharge closed positions and to lock the trigger lever against actuation in especially such a manner as to render the trigger sprayer child-resistant.

SUMMARY OF THE INVENTION

It is therefore an object of the present invention to provide a trigger actuated pump sprayer with a lock bar coupled to the trigger lever in a manner which renders the trigger sprayer child-resistant as both the nozzle is locked in a discharge closed position and the trigger lever is simultaneously locked against actuation. The lock bar can be manually uncoupled so as to provide a first step followed by a second step requiring the bar to be rotated for permitting trigger lever mobilization, this two-step process plus the actual trigger lever actuation thereby rendering the trigger sprayer according to the invention child-resistant given that a child of tender years is unlikely to carry out these three steps successfully for spraying.

More specifically, the trigger sprayer of the invention includes a lock bar connected to the nozzle cap or to a foamer cap on the nozzle cap for rotation in both directions together therewith. The lock bar overlies the front face of the trigger lever and is removably coupled to the lever for locking the trigger against actuation and for locking the nozzle or foamer cap against rotation from a discharge closed position.

The coupling may be in the form of a tab on the lock bar reversely bent to underlie the lever between a pair of trigger lever side walls or the like. And, the tab may be snap fitted in place behind the trigger lever to prevent any inadvertent uncoupling of the lock bar.

Other objects, advantages, and novel features of the invention will become more apparent from the following detailed description of the invention when taken in conjunction with the accompanying drawings.

DETAILED DESCRIPTION OF THE INVENTION

Figure 1:
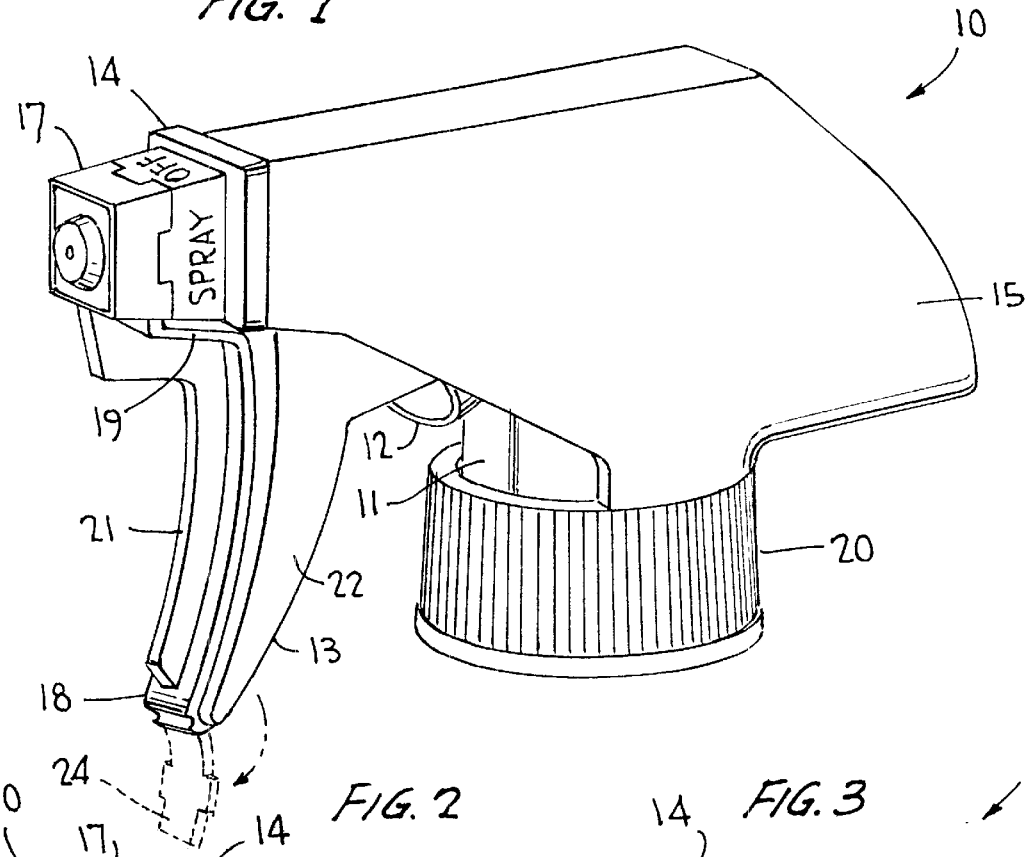
FIG. 1 is a perspective side view of the trigger sprayer incorporating the invention.

Turning now to the drawings wherein like reference characters refer to like and corresponding parts throughout the several views, a trigger actuated pump sprayer incorporating the invention is generally designated 10 in FIG. 1 as including a pump body 11 with a pump piston (not shown) reciprocating within a pump cylinder 12 of the pump body, a trigger lever 13 movably mounted to the pump body with its tup in engagement with the pump piston for the reciprocation thereof upon manual squeeze of the trigger as in a manner known in this art. A container closure 20, which may be internally threaded, is coupled to pump body 11 for mounting sprayer 10 to the neck of a container (not shown) of liquid to be sprayed.

A sprayer nozzle cap 14 is mounted to the pump body at the forward end of a shroud 15 which covers the pump body, the cap being rotatable about its central axis without shifting along that axis, and having a discharge orifice co-axial with the discharge passage (not shown) in the pump body. Internal spin mechanics (not shown) is contained within the nozzle cap such that upon each squeeze of the trigger after the pump is primed liquid product is discharged through its orifice 16 (FIG. 3) in the form of a fine mist spray as in a manner well known in this art. In another of the embodiments disclosed which incorporates the invention, a foamer cap 17 is snap fitted at the forward end of nozzle cap 14 for effecting the spray discharge in the form of a foam when the spray nozzle is rotated into at least one of its discharge open positions. The foamer cap may be in the form of the foamer nozzle as disclosed in U.S. Pat. No. 5,647,539, commonly owned herewith, and specifically incorporated herein by reference.

In accordance with the invention, a lock bar 18 in the form of a curved plate overlies the front face of the trigger lever and is contoured into a complementary shape. The lock bar has an upper mounting position 19 fixedly secured to foamer cap 17. The lock bar may be provided with a central axial rib 21 extending in a forward direction so that in the locked position of the lock bar as shown in FIGS. 1, 2 and 3, the rib provides a sensory alert to the operator that the trigger lever is locked against actuation and the nozzle is locked in its discharge closed position.

Figure 3:
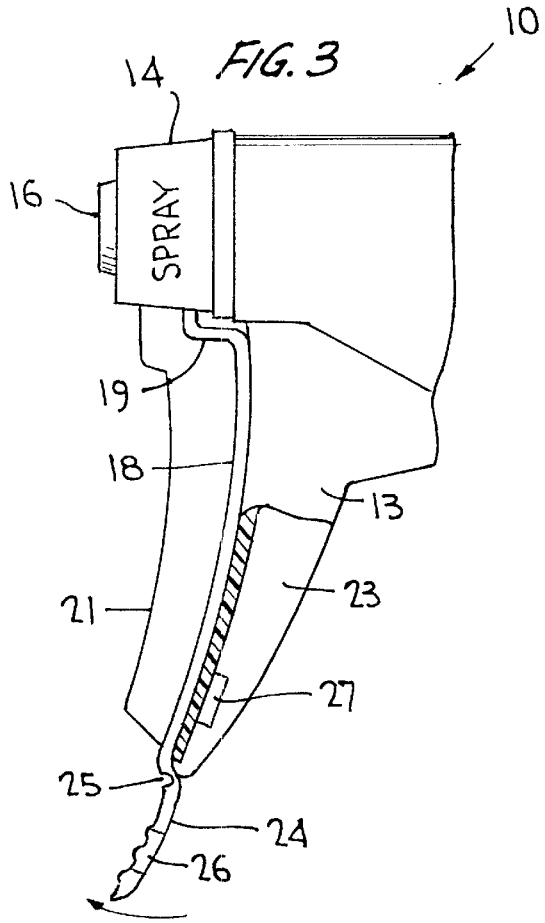
FIG. 3,is a view similar to FIG. 2 for showing a slight modification wherein the lock bar is connected directly to the nozzle cap and showing the lock bar uncoupled from the lever.

The lock bar can instead be fixedly connected directly to nozzle cap 14 as shown in FIG. 3, whether or not a foamer cap 17 is utilized.

Figure 5:
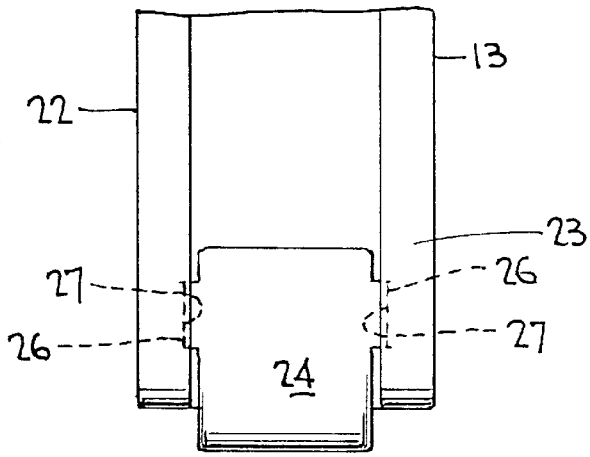
FIG. 5 is a plan view of a portion of the back side of the trigger lever taken substantially along the line 5—5 of FIG. 2.

The trigger lever may have opposed side walls 22, 23 (FIG. 5) offering a cross-section which is substantially C-shaped. The lock bar is coupled to the trigger lever so as to prevent independent rotation of the nozzle cap and/or foamer cap from its discharge closed position. Means for coupling may be in the form of a bendable tab 24 hinged to a free end of lock bar 18 as at 25 to enable the tab to be bent from its FIG. 3 to its FIG. 2 position underlying the front wall of the trigger lever. Tab 24 has a width slightly less than the spacing between side walls 22, 23 of the trigger lever so that when bent to underlie the front wall of the lever the tab will fit snugly and conveniently between side walls 22, 23. In such manner, the tab functions as a means for coupling the lock bar to the trigger lever to prevent rotary movement of the lock bar in either direction from its locked position of FIGS. 1 and 2 thereby immobilizing the trigger lever against actuation and locking the nozzle cap into its discharge closed position.

Figure 2:
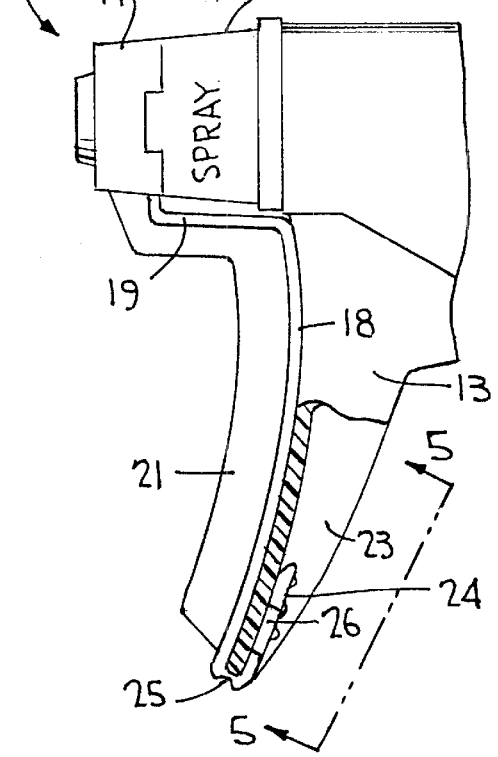
FIG. 2 a side elevational view of a part of the trigger sprayer shown in FIG. 1 and showing the lock bar coupled to the trigger lever.

Depending on the plastic material utilized in molding the lock bar and depending on the elastic memory of the bendable tab to retain its bent position of FIG. 2 disposed between side walls 22 and 23, positive means for retaining the bent tab in place may be of benefit. For this purpose, the bent tab may be provided with outward lateral extensions 26 (FIG. 5) for snap fitting with corresponding cutouts or undercuts 27 in the confronting sides of side walls 22 and 23. The tab will in such manner be positively retained in its FIG. 2 bent position.

Spray nozzle 14 typically has a pair of opposed discharge closed or OFF positions of rotation, and a pair of opposed discharge open positions of rotation one of which being a spray position and the other being either another spray position or a stream position. For the FIGS. 1 and 2 embodiment, the opposed discharge open positions are both SPRAY, while for the FIG. 3 embodiment, the opposed discharge open positions can be a SPRAY and a STREAM.

Figure 4:
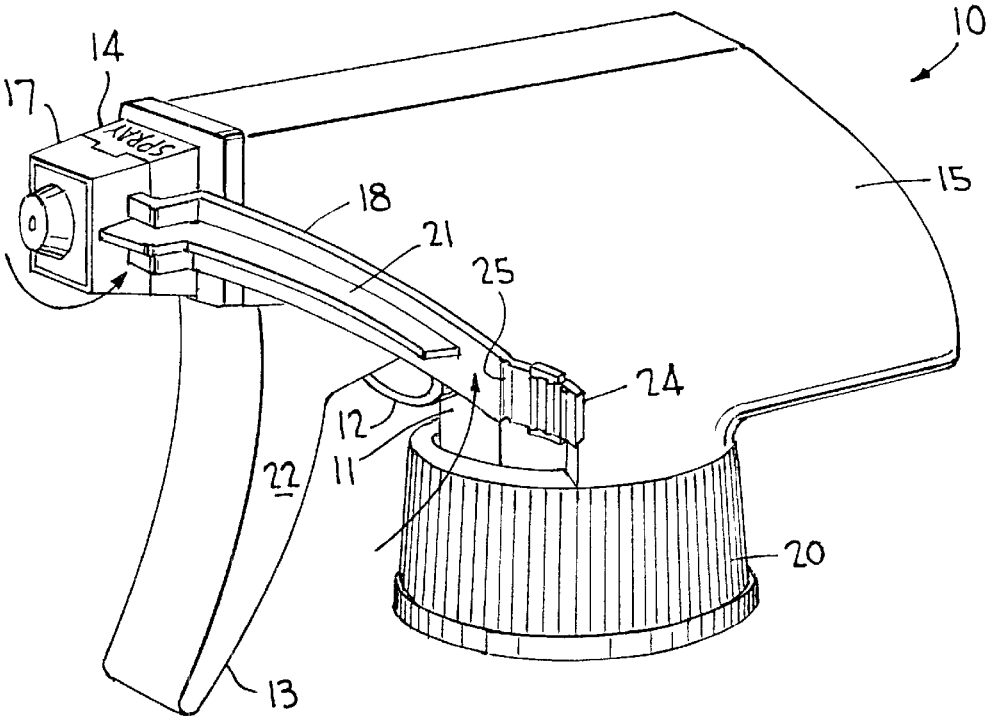
FIG. 4 is a view similar to FIG. 1 but showing the lock bar moved to an unlocked position and the nozzle simultaneously moved to a discharge open position.

As illustrated in FIG. 1, the lock bar is connected to the foamer cap in an OFF position of rotation of the spray nozzle such that when the lock bar overlies the front face of the trigger lever with its tab bent into the FIG. 2 position, the trigger lever is locked against actuation and the nozzle cap is locked against rotation from its discharge closed position. Thus, any attempt to actuate the sprayer even in the discharge closed position of the nozzle cap is positively prevented thereby avoiding the discharge of any residual liquid within the nozzle cap and/or foamer cap even in a discharge closed position. The operator will be immediately alerted to the locked condition of the trigger lever and of the nozzle cap by the central rib 21 which is immediately sensed by the operator when attempting to actuate the trigger. Likewise, a child of tender years will be discouraged from perhaps even attempting to actuate the trigger when grasping over rib 21 which is immediately sensed. And, the multi-step process required to uncouple the lock bar from the trigger lever and to rotate the lock bar and nozzle in either direction to an ON position in readiness for trigger actuation, renders the sprayer child-resistant. Thus, from the fully locked position of FIG. 2 with the tab underlying the front wall of the trigger lever, tab 24 is manually unbent to its position of FIG. 3, likewise shown in phantom outline in FIG. 1, whereupon the spray nozzle is capable of being rotated to a sprayer position as shown in FIG. 4 in either direction from its FIG. 1 position. The trigger lever is now fully accessible to the operator and can be actuated to discharge foam depending on whether a foamer cap is installed, or to spray if no foamer cap is used. To relock the trigger lever and the nozzle cap, the lock bar is simply returned to its FIG. 1 position by rotating it clockwise back to that position, and the tab 24 is re-bent from its FIG. 3 back to its FIG. 2 position.

From the foregoing it can be seen that a simple and economical yet highly effective nozzle lock trigger has been provided for positively locking not only the trigger lever against actuation but the nozzle cap as well against rotation in either direction. The bendable tab is easily manipulable and functions as a simple coupler between the lock bar and the trigger lever, although other couplers of an equivalent nature are available for this purpose without departing from the invention. For example, the bendable tab could be provided on one or both side edges of lock bar 18 for engagement with suitable notches or the like in the side walls of the trigger lever, in carrying out the objective of the invention. Or, some other known manually operable coupler can be applied without departing from the invention.

Obviously, many other modifications and variations of the present invention are made possible in the light of the above teachings. It is therefore to be understood that within the scope of the appended claims the invention may be practiced otherwise than as specifically described.

What is claimed is:

1. A trigger actuated liquid sprayer, comprising a pump body, discharge nozzle means mounted on a forward end said body for rotation about a central axis thereof between discharge open and closed positions upon manual rotation, a trigger lever movably mounted to said body for operating a pumping mechanism upon actuation thereof, a lock bar fixedly mounted to said nozzle means for movement upon the rotation thereof, said lock bar overlying a front face of said lever in the discharge closed position to prevent trigger actuation, and means on said lock bar for removably coupling the lock bar and nozzle means to the lever to prevent nozzle means rotation in opposing direction of rotation and to thereby render the sprayer child-resistant.

2. The sprayer according to claim 1, wherein the lock bar has a raised rib on an outer face thereof to provide a sensory awareness of a locked condition of the trigger lever and the nozzle means.

3. The sprayer according to claim 1, wherein said coupling means comprises a manually bendable tab.

4. The sprayer according to claim 3, wherein the tab is hinged to a lower free end of the lever for engagement upon bending with an underside of the lever.

5. The sprayer according to claim 1, wherein the lever has a pair of spaced, rearwardly directed side walls, said coupling means comprising a tab extending between said side walls for resisting any movement of the trigger lever about the central axis.

6. The sprayer according to claim 5, wherein the tab is removably latched to the lever.

7. The sprayer according to claim 1, wherein the nozzle means comprises a nozzle cap and a connected foamer cap, the lock bar being connected to the foamer cap.

8. The sprayer according to claim 1, wherein the nozzle means comprises a nozzle cap, the lock bar being connected to the nozzle cap.

* * * * *